United States Patent [19]

Bailey et al.

[11] Patent Number: 5,062,479

[45] Date of Patent: Nov. 5, 1991

[54] STRIPPER RUBBERS FOR DRILLING HEADS

[75] Inventors: Thomas F. Bailey; Larry F. Moeller, both of Houston, Tex.

[73] Assignee: MASX Energy Services Group, Inc., Houston, Tex.

[21] Appl. No.: 560,526

[22] Filed: Jul. 31, 1990

[51] Int. Cl.[5] ..... E21B 33/03; E21B 33/08

[52] U.S. Cl. ..... 166/84; 175/84; 277/31

[58] Field of Search ..... 166/84; 175/84, 82; 277/31; 15/104.04, 104.03

[56] References Cited

U.S. PATENT DOCUMENTS

| | | | |
|---|---|---|---|
| 1,942,366 | 1/1934 | Seamark | 175/84 X |
| 3,400,938 | 9/1968 | Williams | 166/84 X |
| 3,934,887 | 1/1976 | Biffle | 277/31 |
| 3,965,987 | 6/1976 | Biffle | 166/84 X |
| 4,154,448 | 5/1979 | Biffle | 277/31 |
| 4,363,357 | 12/1982 | Hunter | 166/84 |
| 4,367,795 | 1/1983 | Biffle | 166/84 |
| 4,423,775 | 1/1984 | Wilson | 166/84 |
| 4,441,551 | 4/1984 | Biffle | 166/84 |
| 4,500,094 | 2/1985 | Biffle | 277/31 |
| 4,955,436 | 9/1990 | Johnston | 166/84 X |

*Primary Examiner*—Stephen J. Novosad

*Attorney, Agent, or Firm*—Edgar A. Zarins; Malcolm L. Sutherland

[57] ABSTRACT

A stripper rubber for use in a drilling head to seal against a work string deployable through the drilling head. The stripper rubber is longitudinally restrained to prevent extrusion of the stripper under pressure and to reduce the tensile and compressive stresses on the stripper rubber. One embodiment of the stripper rubber incorporates upper and lower metal rings which are maintained in spaced apart relation by vertical rods thereby allowing radial expansion as tool joints pass through the rubber but prevents inversion of the stripper rubber under pressure. Reinforcing cords added to the stripper rubber increase the longitudinal strength. A second embodiment bonds a stripper rubber into a cylinder which restrains the rubber in the vertical direction. Radial deflection is accomodated by allowing the rubber to flow vertically as a tool joint passes therethrough. Each of the stripper rubbers incorporates an integrally formed drive bushing which facilitates mounting within the drilling head.

22 Claims, 5 Drawing Sheets

STRIPPER RUBBERS FOR DRILLING HEADS

BACKGROUND OF THE INVENTION

I. Field of the Invention

This invention relates to stripper rubbers used to seal against a drill string deployable through a drilling head and, in particular, to a reinforced stripper rubber for preventing extrusion of the stripper under pressure and reducing the tensile and compressive stresses on the stripper rubber.

II. Description of the Prior Art

Drilling heads are widely used in drilling operations to prevent the drilling fluids from flowing out onto the rig floor. The typical drilling head incorporates a diverter passageway for diverting the drilling fluids, a rotatable drive assembly with bearings to rotate with or drive the drill string, and a stripper rubber positioned within the drilling head. The stripper rubber may be secured to the rotating drive assembly in order to rotate with the drill string and seal against the string to prevent drilling fluids from flowing up through the drilling head. The stripper rubber must be resilient enough to allow various tools and couplings to pass through the drilling head while maintaining the seal. More recent drilling heads have incorporated two axially separated stripper rubbers to maintain the seal thereby preventing fluid flow through the drilling head.

Prior known drilling heads have incorporated stripper rubbers of varying sizes and shapes in order to maintain the desired sealing engagement under the fluid pressures found in drilling operations. The single greatest disadvantage of prior known stripper rubbers is their tendency to extrude and invert under extreme pressures. In the typical assembly, the stripper rubber is mechanically restrained only by the insert at the top of the drilling head. As a tool joint of the drill pipe is lowered through the drilling head, the stripper rubber is pulled in tension and elongates severely until the tool joint has passed through the rubber. Such stretching and elongation results in high stress loads on the stripper rubber. When fluid pressure is applied to the stripper rubber, the rubber is loaded in compression. Since the lower portion of the stripper is unsupported, the rubber can extrude and invert. This problem is exacerbated as a drill string joint is being drawn upwardly through the stripper rubber.

Attempts to eliminate inversion of the stripper rubber have included increasing the strength of the materials and the thickness of the stripper rubber. However, such changes affect the resiliency of the stripper rubber and therefore the ability to maintain the proper seal against the varying thicknesses of the drill string.

Different stripper rubbers have been developed for different applications according to the environment and workload placed upon the rubber. "Shorty" stripper rubbers have been developed for use in minimal clearance drilling heads. High Pressure and Heavy Duty stripper rubbers are used in specialized applications. Thus, a single stripper rubber capable of use in the various drilling heads is needed.

SUMMARY OF THE PRESENT INVENTION

The present invention overcomes the disadvantages of the prior known stripper rubbers by providing a stripper rubber which is reinforced to prevent extrusion and inversion while maintaining the resilient properties required to ensure sealing engagement with the drill pipe as it passes through the drilling head.

The present invention provides three preferred embodiments of a stripper rubber for a drilling head which incorporates reinforcement means to reduce the tensile and compressive stresses while eliminating extrusion under pressure. In a first embodiment, the stripper rubber is vertically restrained by bars which extend between upper and lower rings molded into the stripper rubber. The bars restrain the rubber in the vertical direction but radial expansion is unrestrained to allow tool joints to pass through the drilling head in sealing engagement with the stripper rubber. A second embodiment incorporates reinforcement cords into the stripper rubber to increase the longitudinal strength.

A still further embodiment bonds the stripper rubber into a metal cylinder which acts to restrain the rubber in the vertical direction. Radial deflection as a tool joint passes through the rubber is accommodated by allowing the rubber material to flow vertically.

These stripper rubbers may be mounted into the drilling head using a conventional drive bushing assembly or alternatively using an integral drive bushing which is molded directly into the top of the stripper rubber thereby eliminating the conventional bolt and ring assembly. By incorporating the drive bushing into the stripper rubber reliability and durability are substantially increased. Moreover, the socket screws of the conventional mountings are eliminated reducing the number of parts.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED

Embodiment Of The Present Invention

Figure 1:
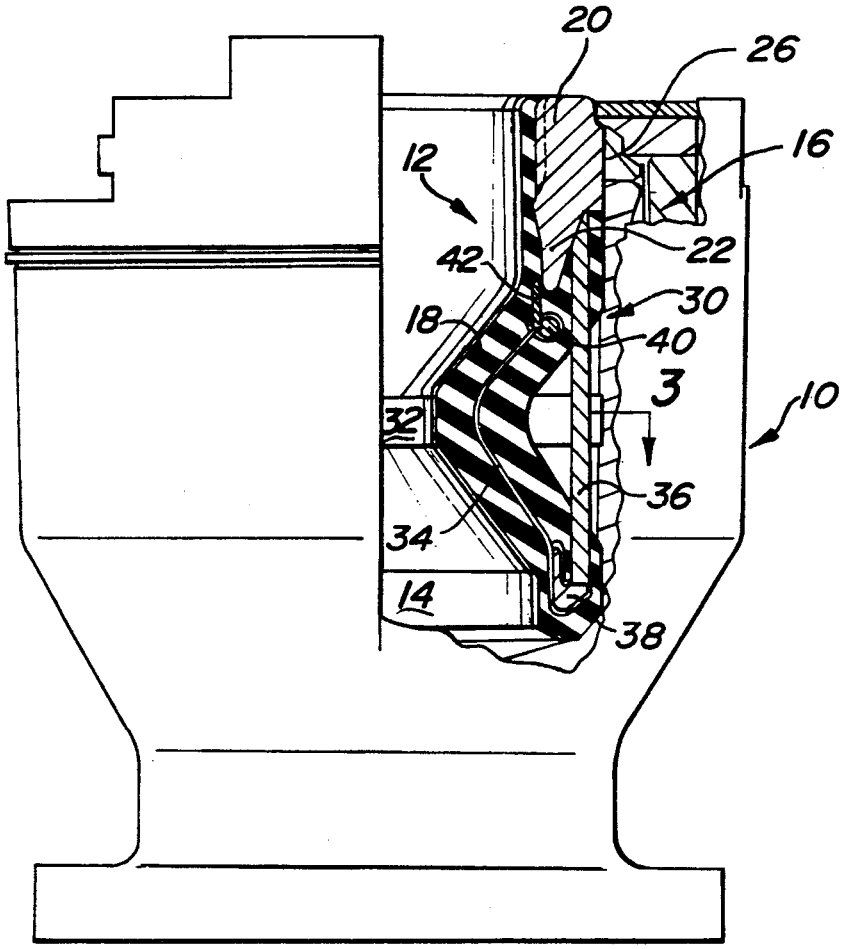
FIG. 1 is a partial cross-sectional view of a drilling head incorporating one embodiment of the stripper rubber of the present invention.

Referring first to FIG. 1, there is shown a drilling head 10 for use in well drilling operations and which incorporates a stripper rubber 12 embodying the present invention. The stripper rubber 12 is preferably removably received within the drilling head 10 for selective replacement as it becomes worn or for insertion of a different stripper rubber 12 to accommodate different operations and/or environments. The stripper rubber 12 may be stationary within the drilling head 10 or may rotate substantially in conjunction with a drill string (now shown) extending through the drilling head 10 and the stripper rubber 12. The stripper rubber 12 is designed to sealingly engage the drill string, including any greater diameter tool joints, as it passes through the drilling head 10 to prevent drilling fluids from flowing up through the drilling head 10 onto the rig floor. Most drilling heads 10 are provided with a diverting passageway to divert the drilling fluids from the rig. Thus, the stripper rubber 12 must be resilient to maintain sealing engagement with the drill string yet strong enough to withstand the pressures associated with drilling operations.

Figure 7:
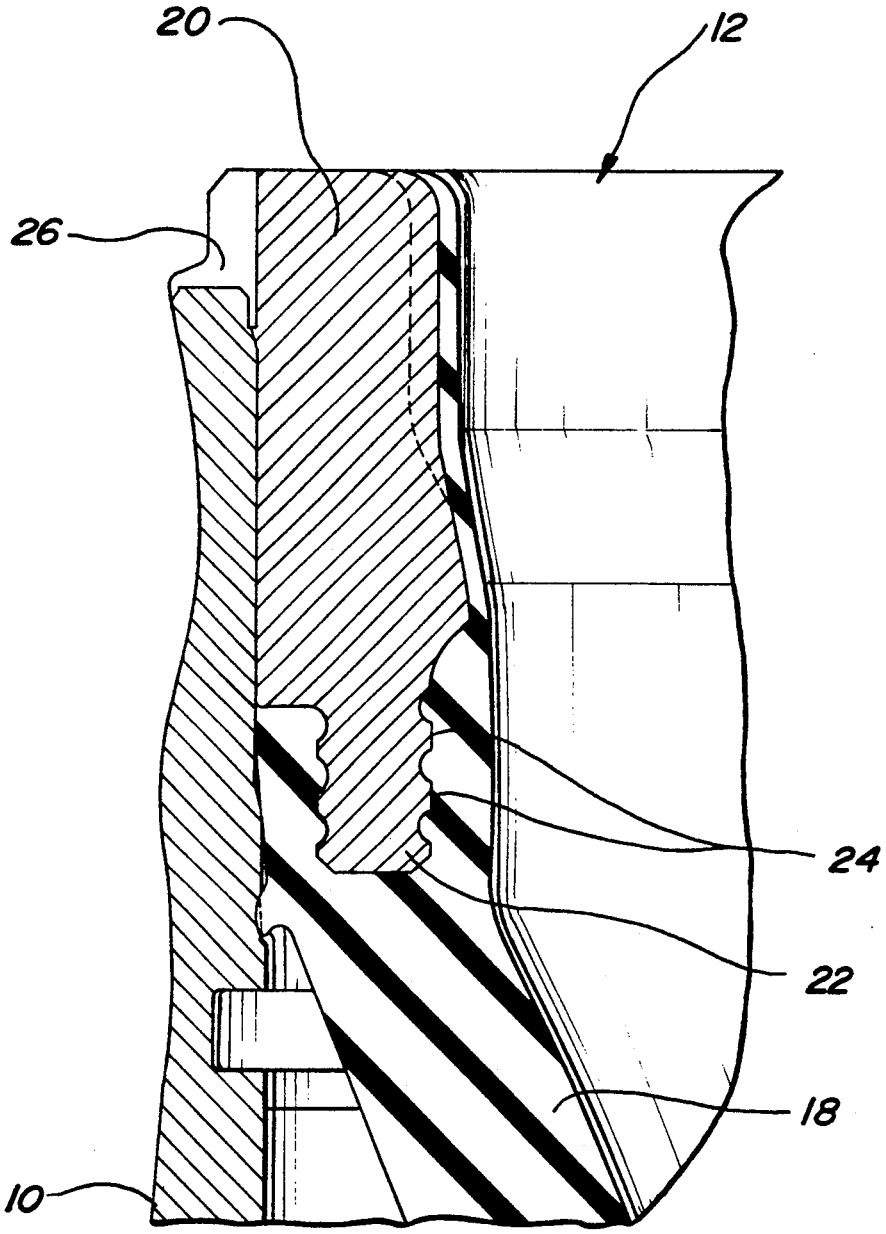
FIG. 7 is a partial cross-sectional view of an integral drive bushing for a stripper rubber.

The stripper rubber 12 is mounted within the axial passageway 14 of the drilling head 10 so as to be supported on top of a bearing assembly 16. The stripper rubber 12 includes combination stripper body 18 and a drive bushing 20 for mounting the stripper rubber 12 within the drilling head 10. In the prior known stripper rubbers, the stripper rubber was separately bolted to the drive bushing. In a preferred embodiment of the present invention, the drive bushing 20 and stripper body 18 are formed in combination by molding the stripper 12 directly to or around the drive bushing 20. In one form of the integral drive bushing 20, an appendage 22 extends into the stripper body 18 to enhance securement. In a still further embodiment, the appendage 22 may include ribs 24 (FIG. 7) which enhance the bond of the stripper body 18 to the drive bushing 20. The drive bushing 20 includes a clamping flange 26 to facilitate secure mounting within the drilling head 10.

Referring now to FIGS. 1 through 4, a first embodiment of the reinforced stripper rubber 12, is there shown. Molded at least partially within the stripper body 18 is restraining means 30 to prevent the stripper rubber 12 from extruding, inverting or generally deforming under the extreme borehole pressures. The restraining means 30 substantially reduces the tensile and compressive stresses upon the stripper rubber 12 while eliminating extrusion under pressure, particularly as the drill string is pulled through the axial passageway 32 of the stripper rubber 12. The restraining means 30 of the first embodiment incorporates at least two pair of support members 36. Reinforcing cords 34 may also be incorporated into the stripper body 18. The cords 34 are radially spaced within the stripper body 18 in a substantially cylindrical configuration and extend longitudinally through the stripper body 18 to increase the longitudinal strength of the stripper 12. The cords 34 are preferably secured to imbedded rings molded into the stripper body 18 coaxially with the passageway 32. A first end of the cords 34 are secured to a lower imbedded ring 38 by wrapping the cords 34 around the ring 38. Similarly, a second end of the cords 34 are secured to an upper imbedded ring 40 proximate the drive bushing 20. Spacer members 42 may also be incorporated into the stripper body 18 for added support. The spacer members 42 engage both the drive bushing appendage 22 and the upper imbedded ring 40 to provide radial support to the upper ring 40 and therefore the reinforcing cords 34. In a preferred embodiment, six to eight spacers 42 are incorporated into the stripper body 18.

Figure 3:
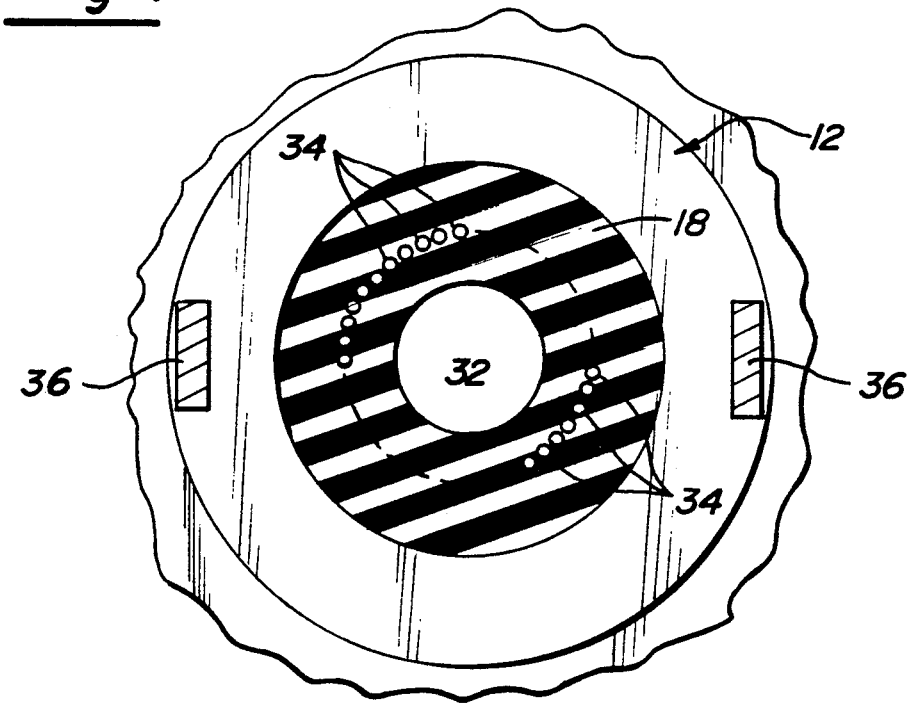
FIG. 3 is a lateral cross-sectional view taken along lines 3—3 of FIG. 1.
Figure 2:
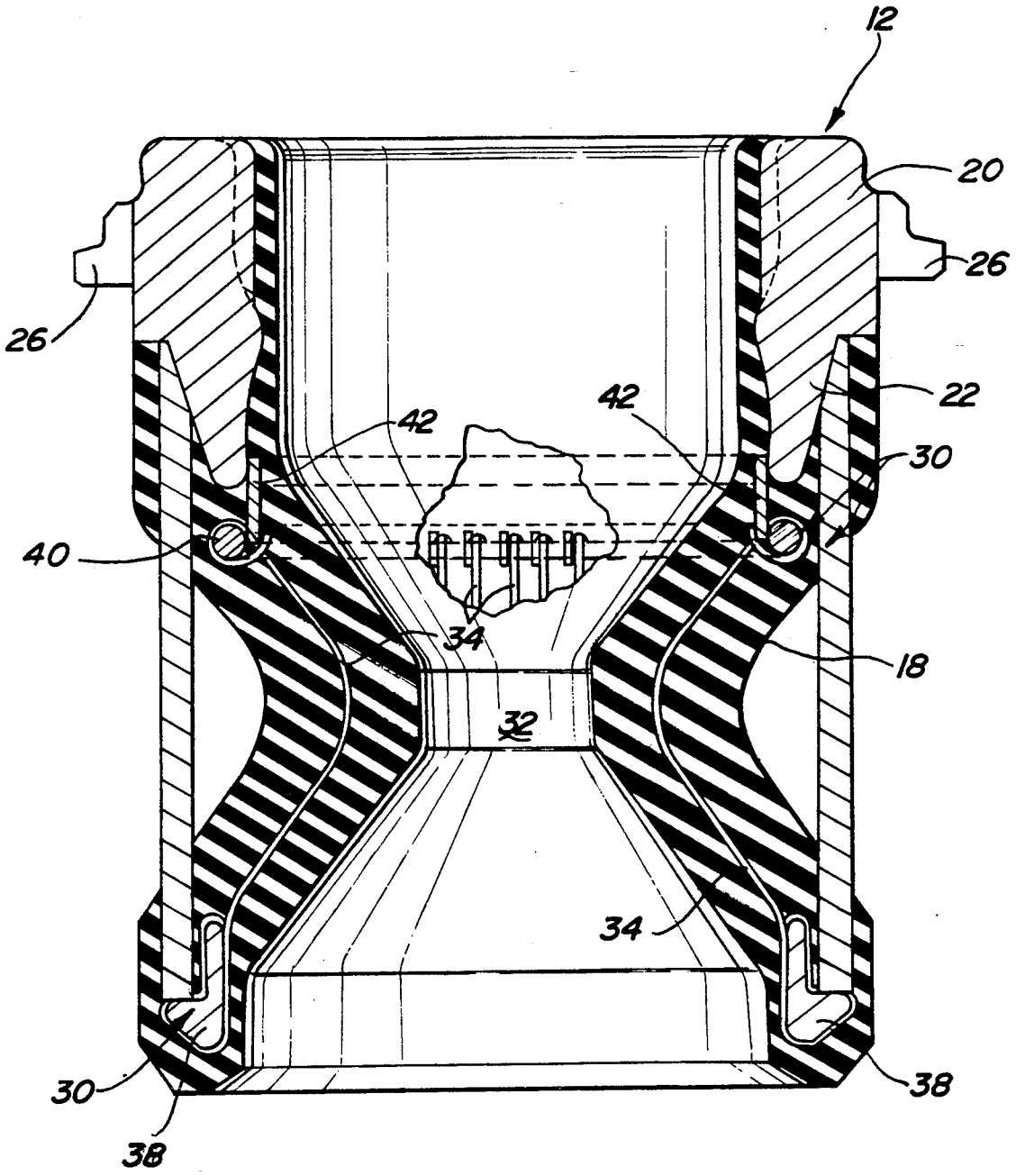
FIG. 2 is a cross-sectional perspective of the stripper rubber.
Figure 4:
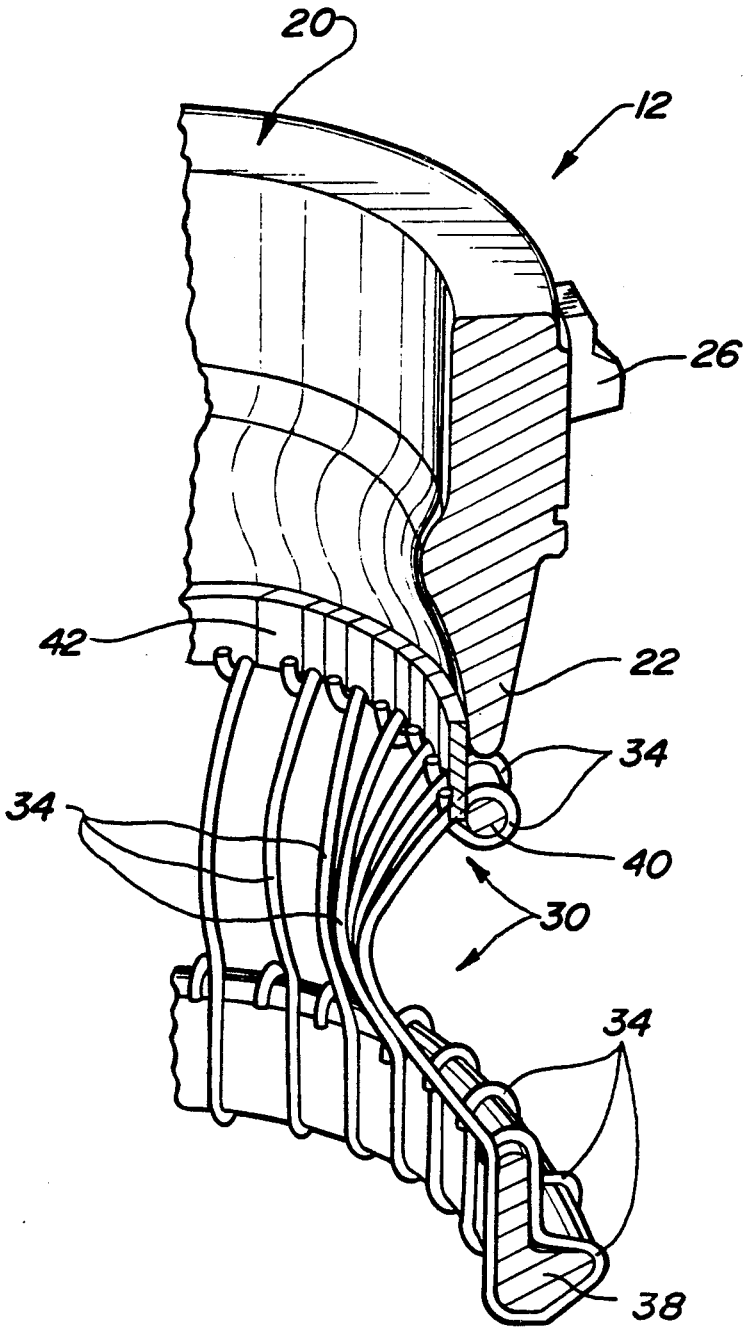
FIG. 4 is a partial perspective view of the reinforcing structure molded into the stripper rubber of the present invention.

While the cords 34 and associated rings are fully imbedded within the stripper body 18, the support members 36 of the first embodiment are only partially imbedded therein. The support members 36 are preferably positioned on opposite sides of the stripper rubber 12 as shown in FIG. 3. The supports 36 extend longitudinally to engage the drive bushing 20 at their upper end and the lower imbedded ring 38 at their lower end to maintain the longitudinal spacing and therefore prevent the lower end of the stripper rubber from inverting or extruding upwardly. Of course, any number of support members 36 may be incorporated into the stripper rubber 12 although it has been found that no more than two are necessary.

Figure 5:
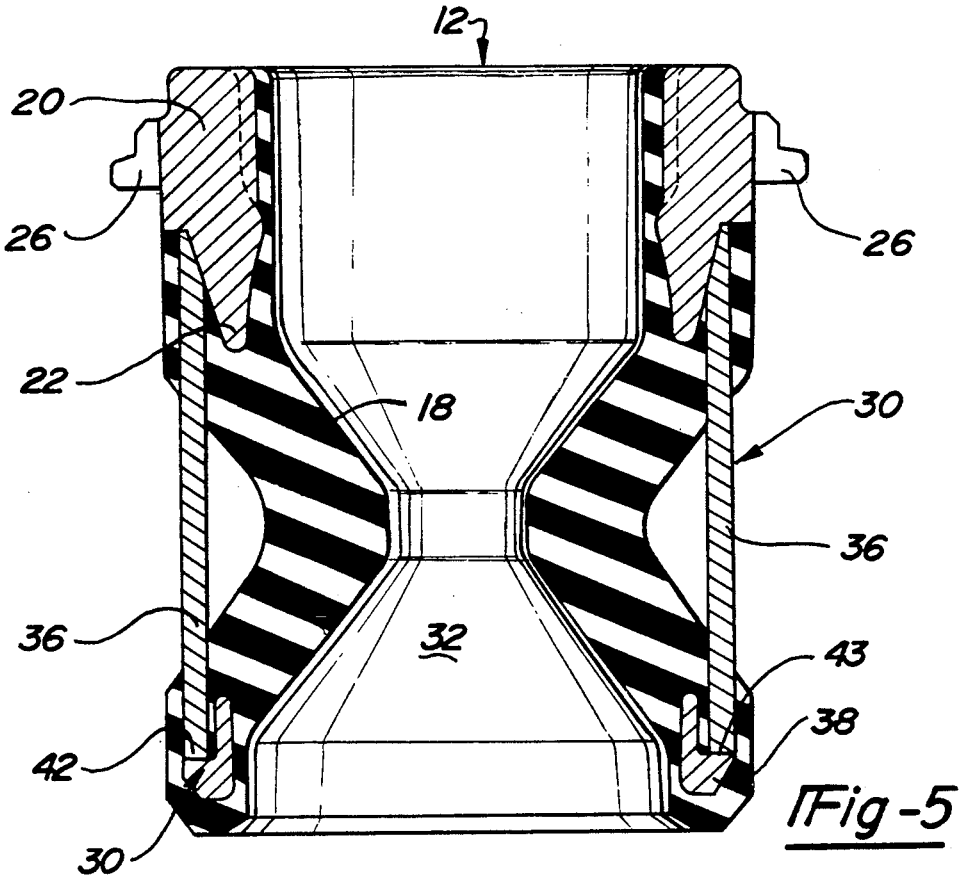
FIG. 5 is a cross-sectional perspective of another embodiment of the stripper rubber of the present invention.

In a second embodiment of the stripper rubber 12 shown in FIG. 5, the reinforcing cords are eliminated to increase the radial flexibility of the stripper body 18. However, the stripper body 18 is supported longitudinally by the support members 36 which extend between the drive bushing 20 and the lower imbedded ring 38. As is shown in FIG. 5, the lower imbedded ring 38 preferably includes a shoulder 43 to engage the lower end of the support members 36.

Figure 6:
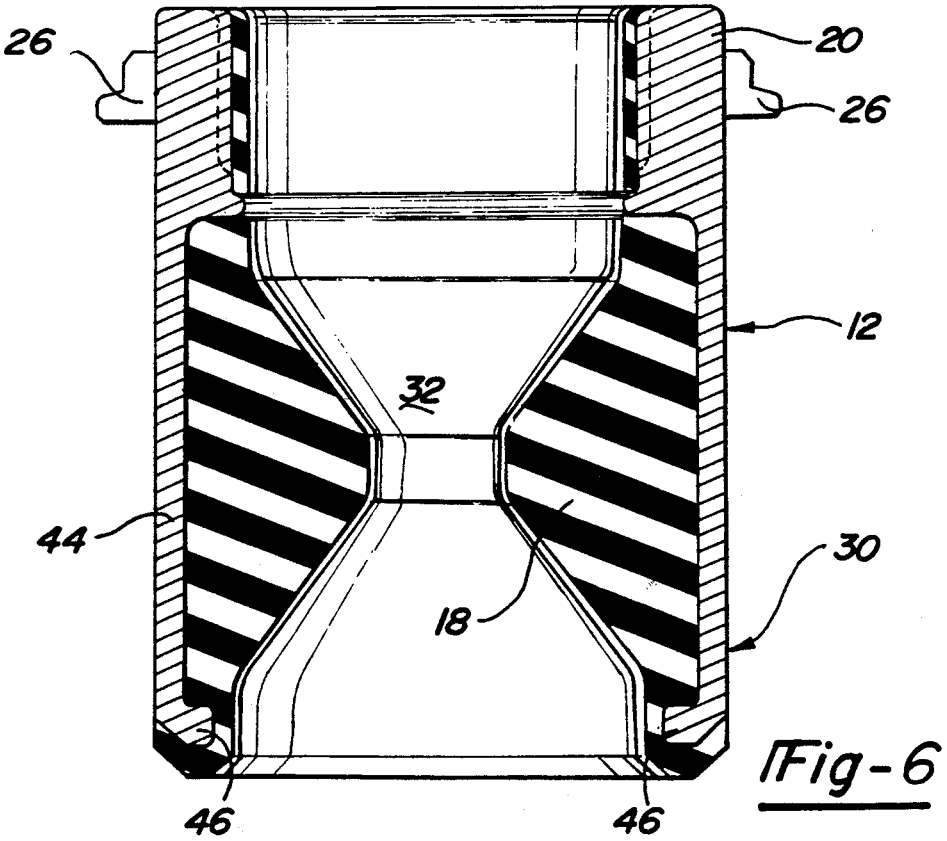
FIG. 6 is a cross-sectional perspective of a still further embodiment of the stripper rubber of the present invention.

A third embodiment of the reinforced stripper rubber 12 is shown in FIG. 6. The drive bushing 20 is formed as part of a cylindrical can 44 within which the stripper body 18 is mounted. The stripper body 18 has an outer cylindrical surface which is bonded within the cylindrical can 44. The lower end of the can 44 is provided with an annular flange 46 which is imbedded into the stripper body 18 to provide added securement of the stripper body 18 within the can 44 particularly as the drill string is drawn through the passageway 32 which tends to pull on the stripper body 18. Radial deflection is accommodated by allowing the rubber to flow vertically as a tool joint passes through the stripper rubber 12.

Thus the present invention provides a reinforced stripper rubber which prevents deformation and inversion even under extreme pressures. Longitudinal support reduces the tensile and compressive forces associated with movement of a drill string through the stripper rubber. Additionally, radial support can be provided by adding radially spaced reinforcing cords.

The foregoing detailed description has been given for clearness of understanding only and no unnecessary limitations should be understood therefrom as some modifications will be obvious to those skilled in the art without departing from the scope and spirit of the appended claims.

What is claimed is:

1. A stripper rubber for use in a well drilling head having a drill string selectively extending therethrough, said stripper rubber comprising:

a stripper body having an axial passageway, said stripper body selectively sealingly engaging the drill string extending through said axial passageway and the drilling head; and means for restraining said stripper body against deformation within the drilling head, said means including an integral drive bushing incorporated into an upper end of said stripper body and at least one longitudinal support member extending between said drive bushing at said upper end of said stripper body and a lower end of said stripper body to restrain said lower end of said stripper body against deformation into said axial passageway.

2. The stripper rubber as defined in claim 1 wherein said means restrains a lower end of said stripper body thereby preventing inversion deformation.

3. The stripper rubber as defined in claim 2 wherein said integrally molded drive bushing facilitates mounting said stripper rubber within the drilling head, said drive bushing having at least one arm extending into said stripper body to secure said stripper body to said drive bushing.

4. The stripper rubber as defined in claim 3 wherein said stripper body includes an integrally molded drive bushing for mounting said stripper rubber within the drilling head, said drive bushing having at least one arm extending into said stripper body to secure said stripper body to said drive bushing.

5. The stripper rubber as defined in claim 4 wherein said restraining means comprises an imbedded ring molded into said stripper body coaxial with said passageway and at least one longitudinal support member extending between said drive bushing and said imbedded ring to provide longitudinal support of said stripper rubber.

6. The stripper rubber as defined in claim 5 wherein said imbedded ring is molded into said stripper body at a lower end of said stripper body, said at least one longitudinal support member engaging said imbedded ring at one end thereof and engaging said drive bushing at another end thereof whereby said ends of said at least one support member are imbedded within said stripper body.

7. The stripper rubber as defined in claim 6 wherein said restraining means includes a pair of longitudinal support members disposed on opposite sides of said stripper body.

8. The stripper rubber as defined in claim 3 wherein said restraining means includes a plurality of circumferentially spaced reinforcement cords longitudinally imbedded within said stripper body.

9. The stripper rubber as defined in claim 8 wherein said stripper body includes at least one ring imbedded therein coaxially with said axial passageway, said reinforcement cords cooperatingly engaging said at least one imbedded ring.

10. The stripper rubber as defined in claim 3 wherein said restraining means comprises a substantially cylindrical can, said stripper body mounted within said cylindrical can.

11. The stripper rubber as defined in claim 10 wherein an outer surface of said stripper body is cylindrical, said outer surface of said stripper body received within said cylindrical can of said reinforcement means.

12. The stripper body as defined in claim 10 wherein a lower end of said can includes an annular flange, said flange extending into said stripper body.

13. The stripper body as defined in claim 11 wherein an upper end of said cylindrical can forms a drive bushing for mounting said stripper rubber within the drilling head.

14. A stripper rubber for use in a well drilling head having a drill string selectively extending therethrough, said stripper rubber comprising:

a stripper rubber having an axial passageway, said stripper body selectively sealingly engaging the drill string extending through said axial passageway and the drilling head; and means for restraining said stripper body against deformation within the drilling head, said restraining means including at least one longitudinal support member at least partially imbedded within said stripper body and at least one imbedded ring molded into said stripper body coaxial with said passageway said at least one longitudinal support member engaging said imbedded ring.

15. The stripper rubber as defined in claim 14 wherein said stripper body includes a plurality of radially spaced reinforcement cords longitudinally imbedded in said stripper body, a first end of said reinforcement cords secured to a lower imbedded ring and a second end of said cords secured to an upper imbedded ring.

16. The stripper rubber as defined in claim 15 wherein said at least one support member engages said lower imbedded ring at one end thereof and another end of said at least one support member engages a drive bushing molded into the upper end of said stripper body, said at least one support member providing longitudinal support of said stripper body to prevent inversion of said stripper rubber.

17. A stripper rubber for use in a well drilling head having a drill string selectively extending therethrough, said stripper rubber comprising:

a stripper body having an axial passageway, said stripper body selectively sealingly engaging the drill string extending through said axial passageway and the drilling head; and means for restraining said stripper body against deformation within the drilling head, said restraining means including at least one longitudinal support member at least partially imbedded within said stripper body and a plurality of circumferentially spaced reinforcing cords imbedded within said stripper body.

18. The stripper rubber as defined in claim 17 wherein said reinforcing means further comprises at least one imbedded ring molded into said stripper body coaxial with said passageway, a lower end of said at least one support member engaging a lower imbedded ring.

19. The stripper rubber as defined in claim 18 wherein said stripper body includes an integrally molded drive bushing for mounting said stripper rubber within the drilling head, an upper end of said at least one support member engaging said drive bushing thereby providing longitudinal support of said stripper body.

20. The stripper rubber as defined in claim 18 wherein a first end of said cords are secured to said lower imbedded ring and a second end of said cords are secured to an upper imbedded ring.

21. A stripper rubber for use in a well drilling head having a drill string selectively extending therethrough, said stripper rubber comprising:

a stripper body having an axial passageway, said stripper body selectively sealingly engaging the drill string extending through said axial passageway and the drilling head, said stripper body having an outer substantially cylindrical surface; and means for restraining said stripper body against deformation within the drilling head, said restraining means including a cylindrical can receiving said stripper body wherein said outer surface of said stripper body is bonded to said cylindrical can, said cylindrical can having a drive bushing formed at the upper end thereof for mounting said stripper rubber within the drilling head.

22. The stripper rubber as defined in claim 21 wherein a lower end of said cylindrical can includes an annular flange extending into said stripper body.

* * * * *